US009994406B2

(12) United States Patent
Ryan

(10) Patent No.: US 9,994,406 B2
(45) Date of Patent: Jun. 12, 2018

(54) APPARATUS FOR DISPENSING ROLLED MATERIAL

(71) Applicant: Paul Joseph Ryan, Lees Summit, MO (US)

(72) Inventor: Paul Joseph Ryan, Lees Summit, MO (US)

(73) Assignee: Toilet Technologies Company, LLC, Lee's Summit, MO (US)

( * ) Notice: Subject to any disclaimer, the term of this patent is extended or adjusted under 35 U.S.C. 154(b) by 464 days.

(21) Appl. No.: 14/717,396

(22) Filed: May 20, 2015

(65) Prior Publication Data

US 2016/0340138 A1 Nov. 24, 2016

(51) Int. Cl.

| | |
|---|---|
| ***B65H 16/02*** | (2006.01) |
| ***B65H 16/06*** | (2006.01) |
| ***B65H 16/00*** | (2006.01) |
| ***A47K 10/34*** | (2006.01) |

(52) U.S. Cl.

CPC ..... *B65H 16/021* (2013.01); *A47K 10/34* (2013.01); *B65H 16/005* (2013.01); *B65H 16/06* (2013.01); *B65H 2301/41308* (2013.01); *B65H 2301/41346* (2013.01); *B65H 2301/41366* (2013.01); *B65H 2402/43* (2013.01); *B65H 2402/5156* (2013.01); *B65H 2402/542* (2013.01); *B65H 2405/40* (2013.01); *B65H 2701/1924* (2013.01)

(58) Field of Classification Search

CPC .... B65H 16/021; B65H 16/005; B65H 16/06; B65H 2301/41346; B65H 2701/1924; B65H 2402/542; B65H 2402/5156; B65H 2301/41366; B65H 2301/41308; B65H 2405/40; B65H 2402/43; A47K 10/34

See application file for complete search history.

(56) References Cited

U.S. PATENT DOCUMENTS

| | | | | |
|---|---|---|---|---|
| 2,555,885 A * | 6/1951 | Hope | A47K 10/40 | 242/596.4 |
| 2,819,852 A * | 1/1958 | Sarro | A47K 10/40 | 242/596.6 |
| 2,978,197 A * | 4/1961 | Anderson | A47K 10/38 | 242/596.4 |
| 3,374,042 A * | 3/1968 | Smith | A47K 10/38 | 242/560.3 |
| 4,614,312 A * | 9/1986 | Del Pino | A47K 10/40 | 242/559 |
| 6,186,439 B1 * | 2/2001 | Carey | A47K 10/38 | 242/596.3 |

(Continued)

*Primary Examiner* — William A. Rivera

(74) *Attorney, Agent, or Firm* — Mashburn Law Office, LLC; Donna Denise Mashburn Chapman

(57) ABSTRACT

A rolled material dispensing apparatus including a housing, a frame, first and second retention structure, first and second ball bearings, first and second biasing components, and mounting structure. Sides of the frame form an open-front dispensing chamber and include first and second apertures for at least partially receiving the ball bearings therethrough. The retention structure retain the ball bearings and biasing components therein. The ball bearings may be urged out of the way of the roll of material when the roll is loaded into the apparatus. The biasing components urge the ball bearings at least partially through the apertures into ends of the roll when the roll is in a loaded position for retaining the roll in the dispensing chamber.

20 Claims, 8 Drawing Sheets

(56) References Cited

U.S. PATENT DOCUMENTS

| | | | | |
|---|---|---|---|---|
| 2006/0163418 | A1* | 7/2006 | Ko | A47K 10/40<br>242/596.4 |
| 2007/0131818 | A1* | 6/2007 | Ko | A47K 10/40<br>242/596.4 |

* cited by examiner

APPARATUS FOR DISPENSING ROLLED MATERIAL

FIELD OF INVENTION

Embodiments of the present invention relate generally to the field of rolled material dispensing apparatuses. More specifically, the present invention relates to rolled material dispensing apparatus for dispensing toilet tissue, paper towels, tape, wrapping paper, plastic bag products, films, foils, wire, ribbon, labeling products, or any rolled material.

BRIEF SUMMARY

The present invention is a rolled material dispensing apparatus including a housing, a frame, first and second retention structure, first and second ball bearings, first and second biasing components, and mounting structure.

The housing at least partially encloses the frame and includes one or more outer walls for protecting components of the apparatus. The housing may be welded together, held together by fasteners or adhesives, or unitarily formed out of a single piece of material. The walls of the housing may be spaced from the frame so as to form a rear-opening secondary chamber therebetween for providing access to the ball bearings and biasing components.

The frame at least partially encloses the material roll and includes one or more sides spaced from the walls of the housing. The sides cooperatively form an open-front dispensing chamber for receiving the material roll therein. Opposing sides of the frame may include first and second apertures, respectively. The apertures each have a diameter smaller than the diameter of the ball bearings for partially receiving the ball bearings therethrough.

The first and second retention structure form open-ended chambers therein for retaining the ball bearings and biasing components therein and are positioned adjacent the apertures. The retention structure may be removably connected to the sides of the frame or may be integrally formed with the frame.

The ball bearings engage ends of the material roll and may freely spin as the roll is being turned. The ball bearings are larger in diameter than the diameter of the apertures so that they cannot move all the way through the apertures.

The biasing components bias the ball bearings against the sides of the frame so that the ball bearings at least partially extend through the apertures. The biasing components may be coil springs, torsion springs, pressurized shocks, magnets, or any other suitable biasing components.

The mounting structure secures the apparatus to a restroom or bathroom wall, stall, or other fixture or surface and may include fastener holes, interlocking geometry, friction fitting, or other structure. Alternatively, the mounting structure may include legs or feet for placing the apparatus on the floor or surface of a bathroom fixture.

This summary is provided to introduce a selection of concepts in a simplified form that are further described in the detailed description below. The summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
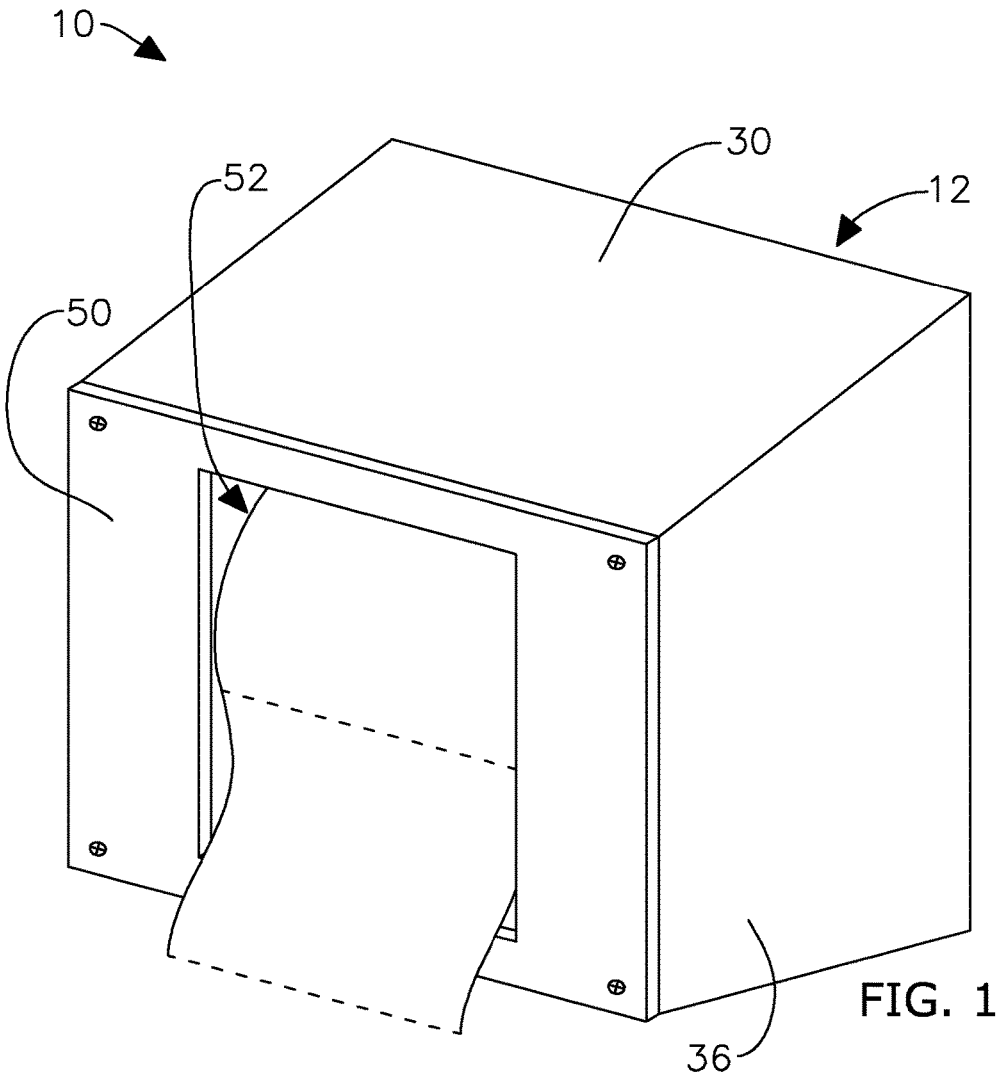
FIG. 1 is a perspective view of a rolled material dispensing apparatus, constructed in accordance with an embodiment of the invention.
Figure 2:
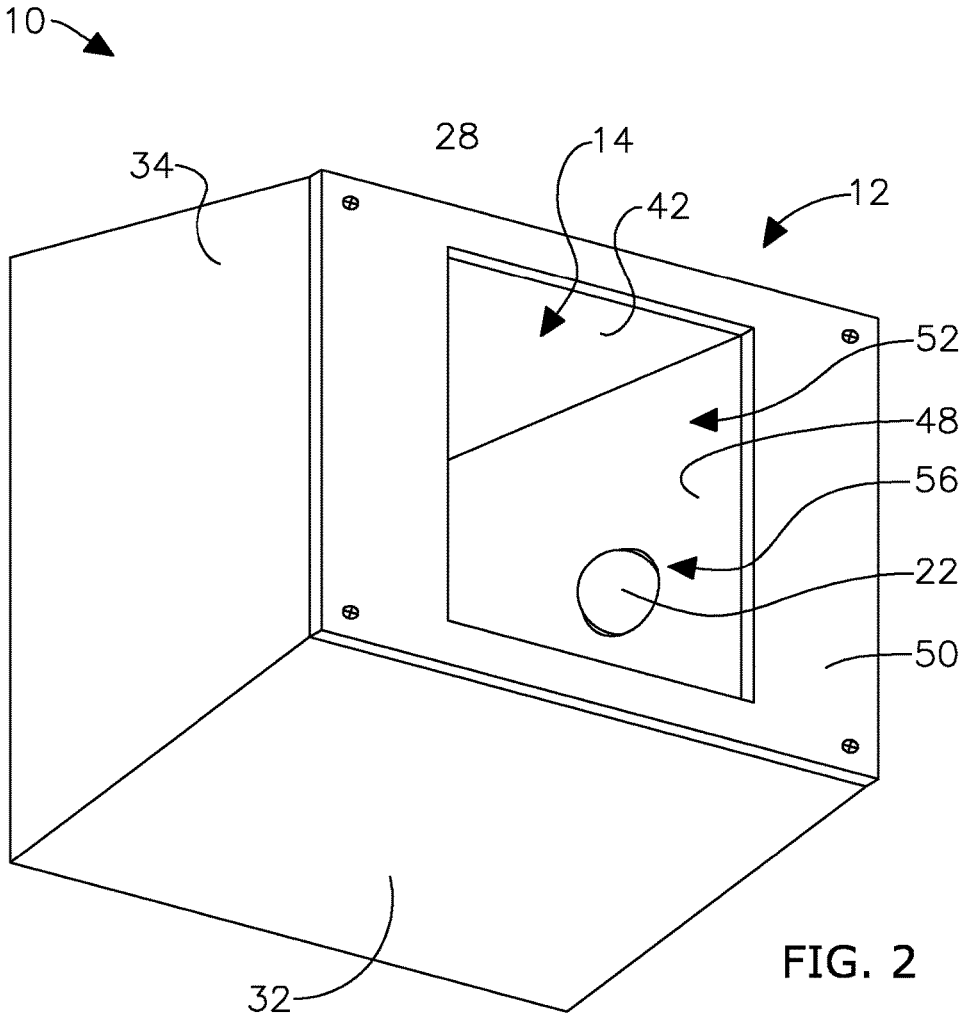
FIG. 2 is a bottom perspective view of the apparatus of FIG. 1.
Figure 3:
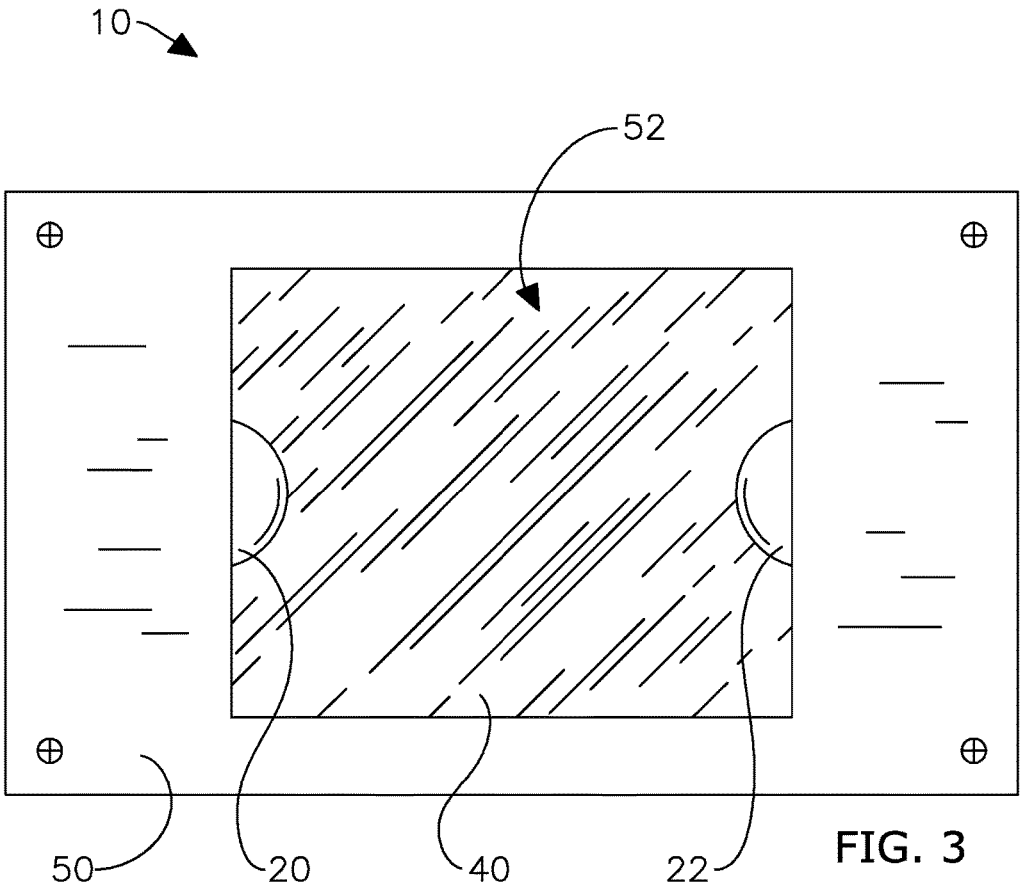
FIG. 3 is a front elevation view of the apparatus of FIG. 1.
Figure 4:
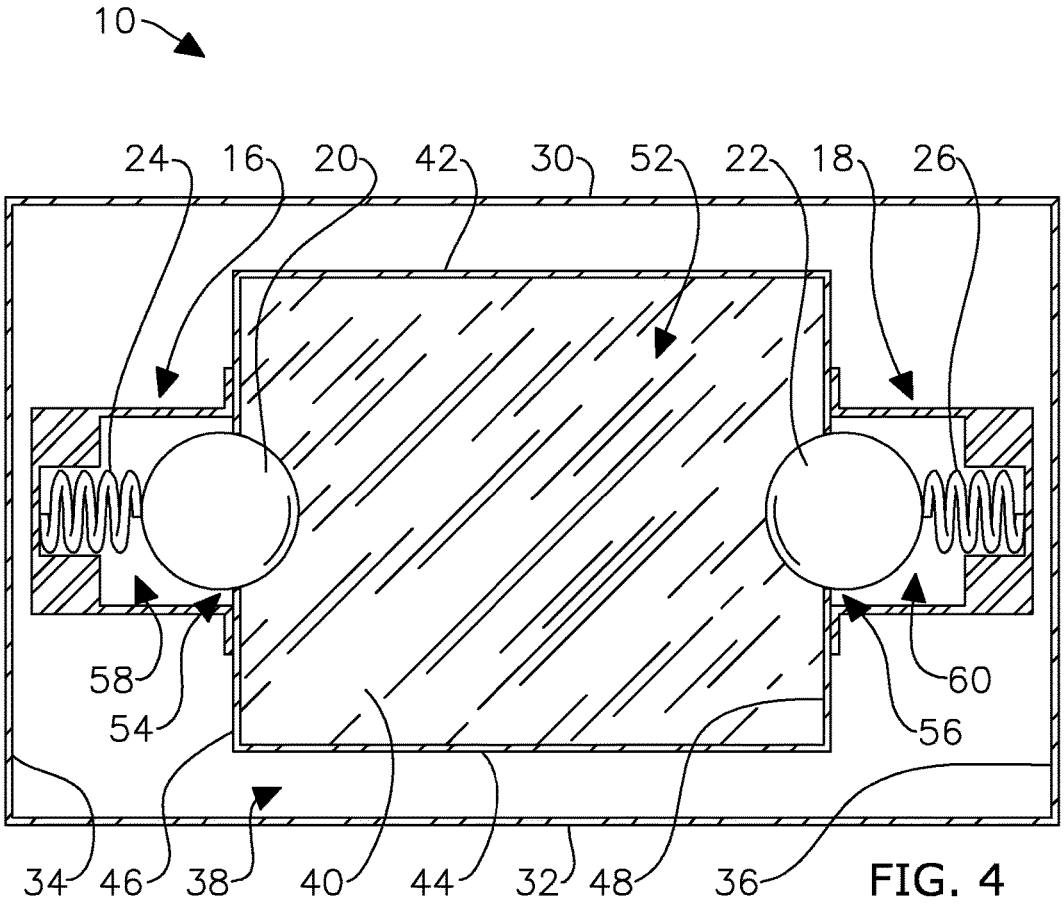
FIG. 4 is a cutaway view of the apparatus of FIG. 1 showing the ball bearings in a deployed position.
Figure 5:
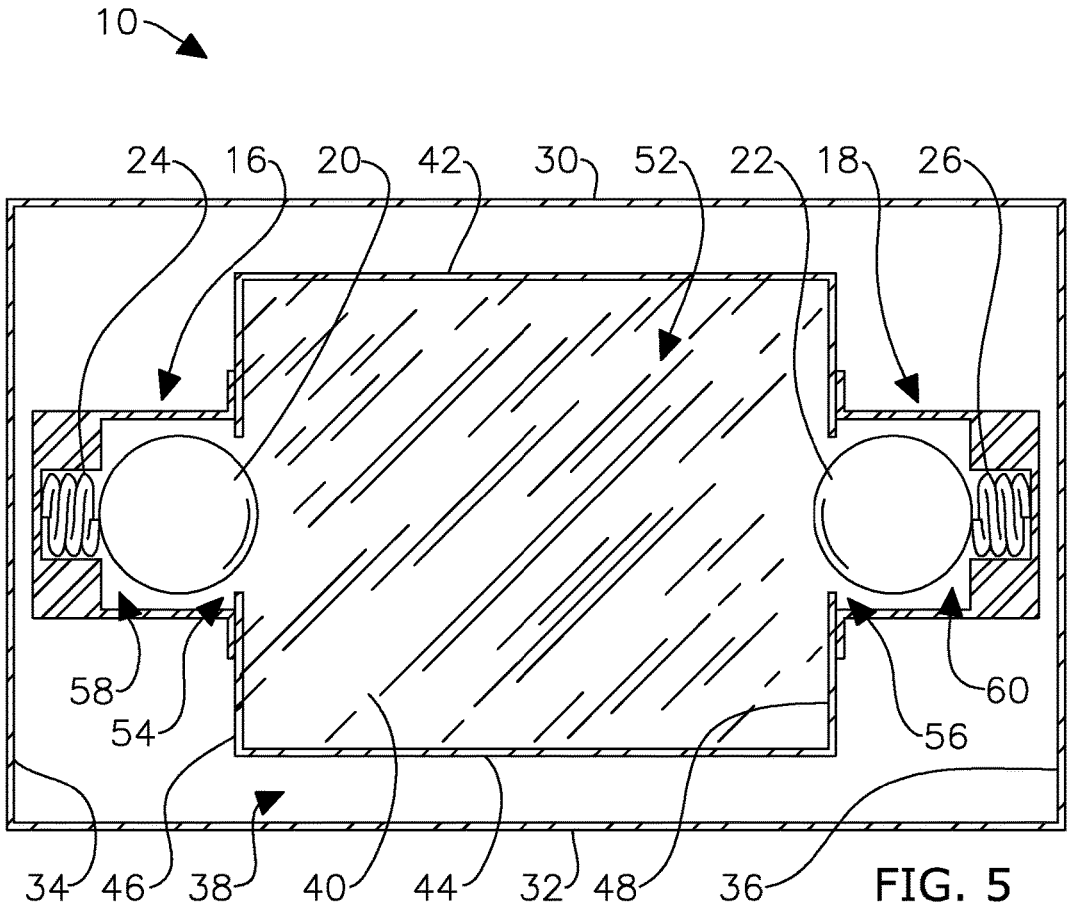
FIG. 5 is a cutaway view of the apparatus of FIG. 1 showing the ball bearings in a cocked position.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to FIGS. 1-6, an embodiment of the present invention is a rolled material dispensing apparatus 10 broadly comprising a housing 12, a frame 14, first and second retention structure 16, 18, first and second ball bearings 20, 22, first and second biasing components 24, 26, and mounting structure 28.

The housing 12 at least partially encloses the frame 14 and broadly includes an outer top wall 30, an outer bottom wall 32, a first outer sidewall 34, and a second outer sidewall 36 opposite the first outer sidewall 34. The housing 12 at least partially protects the components of the apparatus 10 and rolls of material being held therein. The housing 12 may be formed of sheet metal, molded plastic, ceramics, or any other suitable material. The housing 12 may be welded together, held together by fasteners or adhesives, or unitarily formed out of a single piece of material. The housing 12 may be shaped to fit into a pre-cut hole of a restroom stall or a restroom or bathroom wall and may be sloped so that the front of the housing is shorter than the back of the housing.

The outer top wall 30, outer bottom wall 32, first outer sidewall 34, and second outer sidewall 36 of the housing 12 may be spaced from sides of the frame 14 so as to form a secondary chamber 38 therebetween. The secondary chamber 38 may be open to the rear of the housing 12 for providing access to the ball bearings 20, 22 and biasing components 24, 26 when the apparatus 10 is removed from the wall or stall.

The frame 14 at least partially encloses the material roll and broadly includes a back side 40, a top side 42, a bottom side 44, a first side 46, a second side 48 opposite the first side, and a front face 50. The back side 40, top side 42, bottom side 44, and first and second sides 46, 48 cooperatively form an open-front dispensing chamber 52 for receiving the material roll therein. The first and second sides 46, 48 may include first and second apertures 54, 56 respectively. Alternatively, the apertures 54, 56 may be located in the top and bottom sides 42, 44 for dispensing material vertically. The apertures 54, 56 may be positioned opposite from each other and each may be circular for partially receiving the ball bearings 20, 22 therethrough, as described below. The apertures 54, 56 may be smaller in diameter than the diameter of the ball bearings 20, 22 for preventing the ball bearings from moving completely therethrough. The front face 50 may extend flush or nearly flush with the walls of the housing 12 and may include fastener holes, interlocking geometry, or other means for connecting the frame 14 to the housing 12. The frame 14 may be formed of sheet metal, molded plastic, ceramics, or any other suitable material and may be integrally formed with the housing 12. Alternatively, the frame 14 may be removably attached to the housing 12 via fasteners or interlocking geometry for providing access to the ball bearings 20, 22 and biasing components 24, 26.

The first and second retention structure 16, 18 each form an open-ended chamber 58, 60 and retain the ball bearings 20, 22 and biasing components 24, 26 therein. The chambers 58, 60 each may be cylindrical or other suitable shape with a diameter large enough to fit one of the ball bearings 20, 22 therein and may be elongated for retaining one of the biasing components 24, 26 behind the bearing. The retention structure 16, 18 may be removably attached to the frame 14 and/or the housing 12 via fasteners or interlocking geometry or openable for accessing the ball bearings 20, 22 and biasing components 24, 26. The retention structure 16, 18 may be molded material surrounding the chambers 58, 60 or may comprise tubular metal components or the like.

The first and second ball bearings 20, 22 retain the material roll in a seated position, as described below, and may be substantially spherical balls positioned in the chambers 58, 60 of the retention structure 16, 18. The ball bearings 20, 22 have a diameter greater than the diameter of the apertures 54, 56 and are small enough to fit in one of the chambers 58, 60. The ball bearings 20, 22 may have a substantially smooth and homogeneous surface for spinning or rotating as material is dispensed from the material roll. The ball bearings 20, 22 may be solid or hollow and may be formed of plastic, metal, ceramics, or any other suitable material.

The first and second biasing components 24, 26 bias the ball bearings 20, 22 against the sides 34, 36 of the frame 14 and may be positioned in the chambers 58, 60 behind the ball bearings 20, 22. The biasing components 24, 26 may be coil springs, leaf springs, torsion springs, pressurized shocks, magnets, or any other suitable biasing components.

Figure 6:
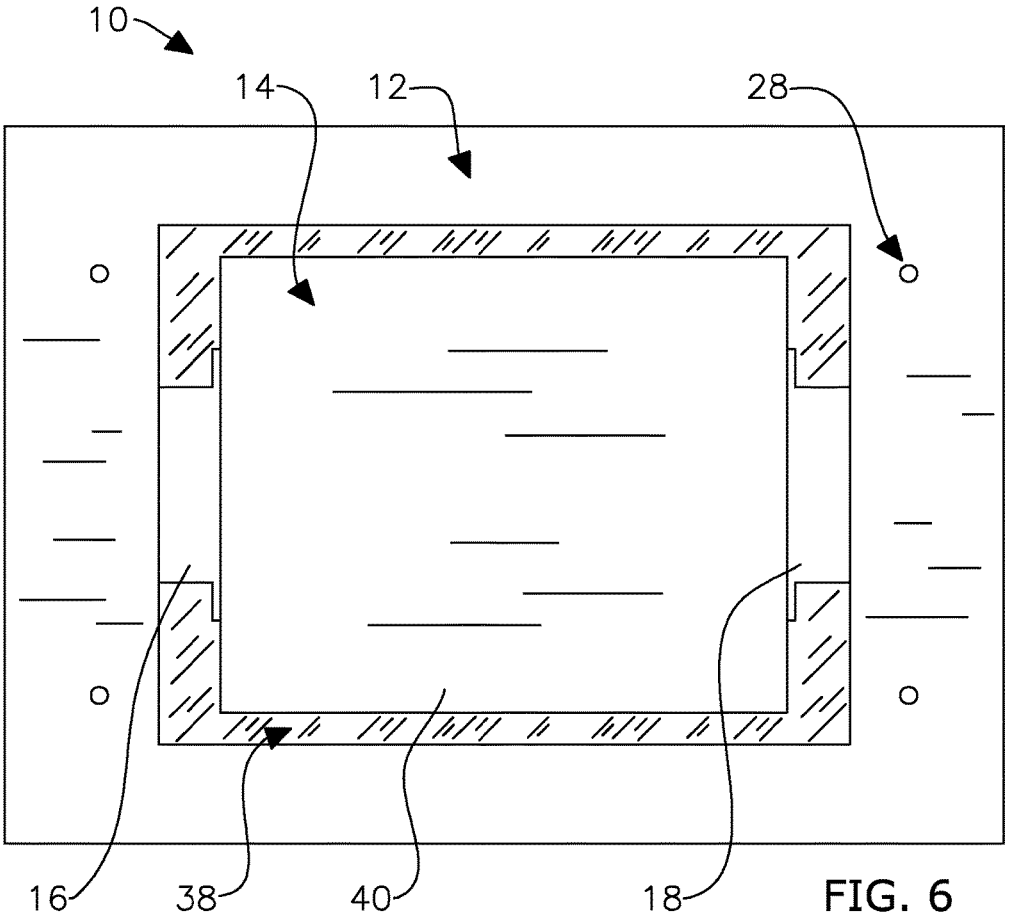
FIG. 6 is a rear elevation view of the apparatus of FIG. 1.

The mounting structure 28 secures the apparatus 10 to a restroom or bathroom wall, stall, or other fixture or surface and may include fastener holes and the like, interlocking geometry, friction fitting, or other structure. For example, the mounting structure 28 may include a number of fastener holes located at the back of the housing 12, as shown in FIG. 6. Alternatively, the mounting structure 28 may include legs or feet for placing the apparatus 10 on the floor or surface of a bathroom fixture.

Use of the dispensing apparatus 10 will now be described in more detail. First, a roll of material may be loaded into the apparatus 10 by pushing the roll into the dispensing chamber 52. The roll may push against the ball bearings 20, 22 so as to overcome the biasing force of the biasing components 24, 26 until the ball bearings 20, 22 are sufficiently urged from a deployed position (FIG. 4) away from the apertures 54, 56 to a cocked position (FIG. 5) such that the roll may be moved towards a seated position in the dispensing chamber 52. As the roll is positioned in the seated position, the biasing components 24, 26 may urge the ball bearings, 20, 22 partially through the apertures 54, 56 (the deployed position of FIG. 4) so that the ball bearings 20, 22 extend into end recesses or openings of the roll such that the ball bearings 20, 22 retain the roll therebetween. A user may then pull material from the roll such that the roll turns from the force of the pull. The roll may slip on the ball bearings 20, 22 or the ball bearings may turn with the roll and slip on the edges of the apertures 54, 56 and the biasing components 24, 26. The roll may be removed from the apparatus 10 when depleted by pulling the roll such that the ball bearings 20, 22 overcome the biasing force of the biasing components 24, 26 and are urged out of the way of the roll. The ball bearings 20, 22 and/or biasing components 24, 26 may be serviced by accessing the retention structure 16, 18 via the rear opening of the secondary chamber 38.

The above-described apparatus 10 provides numerous advantages over the prior art. For example, the apparatus 10 is difficult to tamper with and the components of the apparatus 10 are self-contained. That is, the ball bearings 20, 22 and biasing components 24, 26 will not fall out of the apparatus 10, break apart, or become fatigued. A roll of material can be loaded into the apparatus 10 simply by pushing the roll into the dispensing chamber 52. That is, a user does not need to open, unhinge, turn, or move components with his free hand to load the roll of material. The apparatus 10 is also ergonomically shaped and easily cleaned and serviced. The apparatus 10 does not include a spindle inserted inside the rolled material that can be lost, stolen, or misused. In addition, the apparatus 10 does not have parts that a user could misuse or injure himself with, as may be desired in prisons, nursing homes, mental hospitals, juvenile detention facilities, or similar settings.

Figure 7:
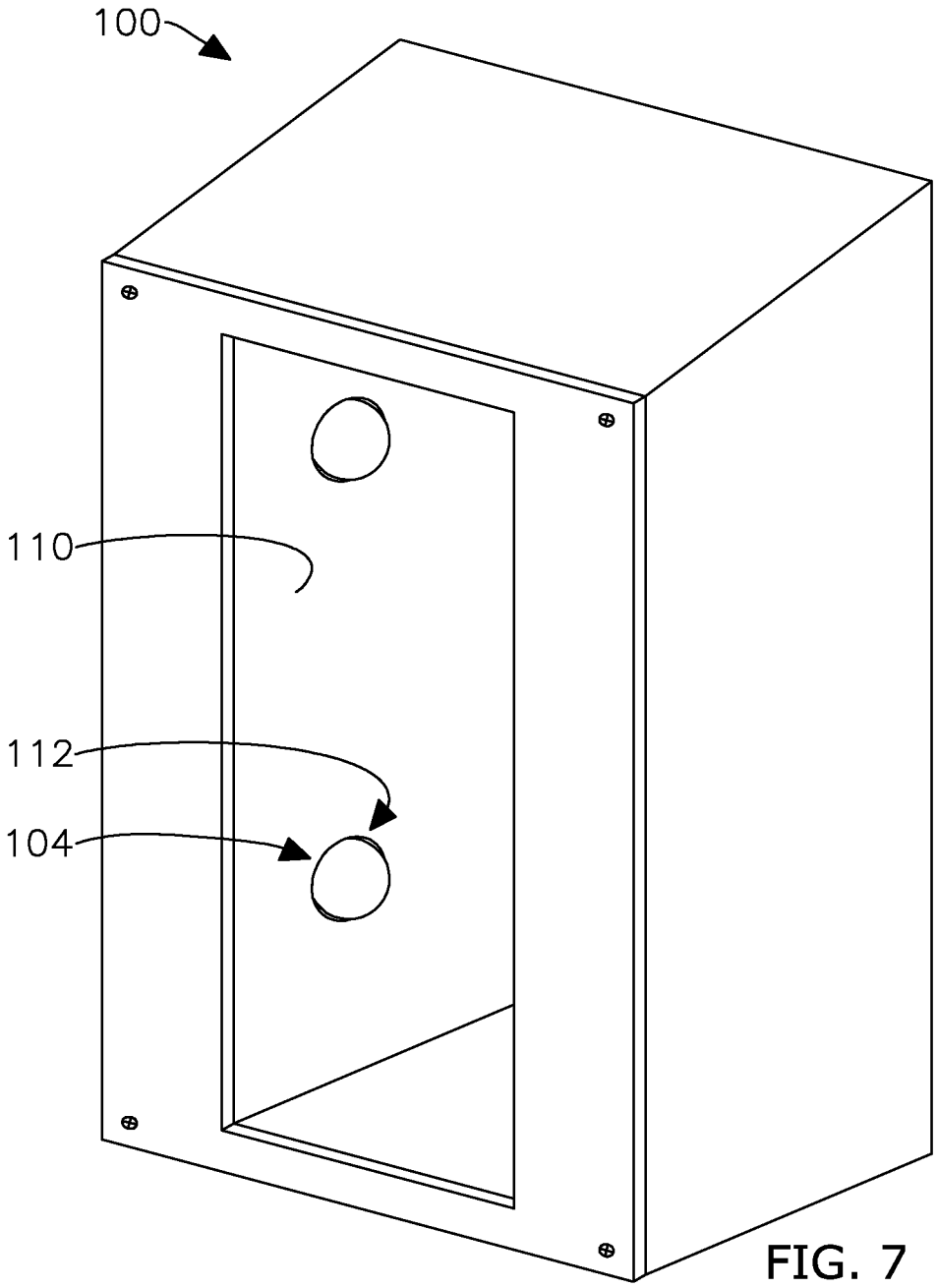
FIG. 7 is a perspective view of an apparatus constructed in accordance with another embodiment of the present invention.
Figure 8:
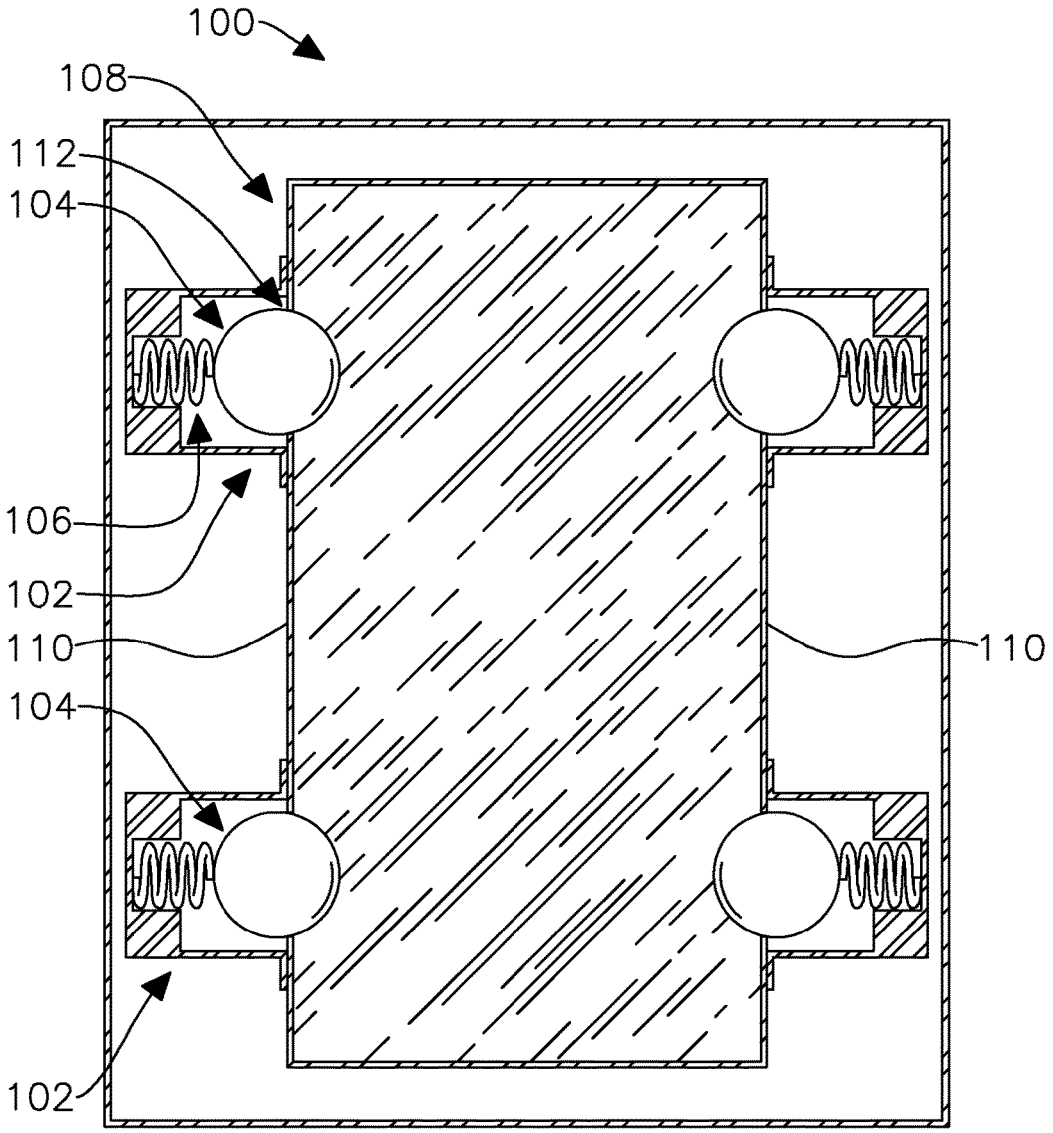
FIG. 8 is a cutaway view of the apparatus of FIG. 7.

Another embodiment of the present invention is a dispensing apparatus 100 similar to the apparatus 10 described above except that the apparatus 100 includes two sets of retention structure 102, two sets of ball bearing pairs 104, and two sets of biasing component pairs 106 similar to the components described above, as shown in FIGS. 7 and 8. The frame 108 has two sides 110 that are elongated so that two rolls of material may fit one above the other with space in between. The sides 110 each include two sets of apertures 112 spaced from each other for spacing the ball bearing pairs 104 from each other.

In another embodiment, the apparatus 10 may not include a housing 12 and the frame 14 may fit into a pre-cut hole of a wall or other fixture or surface. The front face 50 of the frame 14 may extend flush or nearly flush with the wall, fixture, or surface and may include fastener holes and the like for mounting the frame 14. Alternatively, the back side 40 of the frame 14 may be connected to a structure located inside the pre-cut hole. The frame 14 may be removably attached for providing access to the ball bearings 20, 22 and biasing components 24, 26.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. An apparatus for dispensing rolled material from a roll having openings on opposite sides thereof, the apparatus comprising:

a frame comprising:
- a back side;
- a first side extending from a first end of the back, the first side including a first aperture;
- a second side extending from a second end of the back opposite the first end, the second side including a second aperture opposite the first aperture;
- a top side; and
- a bottom side opposite the top side, the top side, bottom side, back side, and first and second sides cooperatively forming an open-front dispensing chamber for receiving the roll therein;

a first bearing positioned near the first aperture;

a first biasing component configured to bias the first bearing towards the first aperture such that at least a portion of the first bearing extends through the first aperture;

a second bearing positioned near the second aperture;

a second biasing component configured to bias the second bearing towards the second aperture such that at least a portion of the second bearing extends through the second aperture, the bearings being configured to be selectively shifted away from the apertures for inserting the roll into a seated position and being configured to retain the roll in the seated position when the biasing components bias the bearings towards the apertures;

a housing comprising:
- an outer top wall spaced from the top side;
- an outer bottom wall spaced from the bottom side;
- a first outer sidewall spaced from the first side; and
- a second outer sidewall spaced from the second side; and an open-ended secondary chamber between the frame and the housing.

2. The apparatus of claim 1, further comprising a first retention structure forming a first chamber extending outwardly from the first aperture for retaining the first bearing and the first biasing component therein and a second retention structure forming a second chamber extending outwardly from the second aperture for retaining the second bearing and the second biasing component therein.

3. The apparatus of claim 2, wherein the first retention structure is removably attached to the first side and the second retention structure is removably attached to the second side.

4. The apparatus of claim 2, wherein the first and second retention structures being positioned in the open-ended secondary chamber.

5. The apparatus of claim 2, wherein the first and second retention structures are accessible via the open-ended secondary chamber.

6. The apparatus of claim 1, further comprising a mounting structure positioned at the back of the apparatus for mounting the apparatus to an external structure.

7. The apparatus of claim 5, further comprising at least one fastener hole in the mounting structure for receiving a fastener therethrough.

8. The apparatus of claim 1, wherein the housing is shorter near its front than near its back so as to form an ergonomic shape.

9. The apparatus of claim 1, wherein the bearings are spherical.

10. The apparatus of claim 1, wherein the biasing components are coil springs.

11. An apparatus for dispensing rolled material from at least two rolls each having openings on opposite sides thereof, the apparatus comprising:

a frame comprising:
- a back side;
- a first side extending from a first end of the back, the first side including a first aperture and a second aperture spaced from the first aperture;
- a second side extending from a second end of the back opposite the first end, the second side including a third aperture opposite the first aperture and a fourth aperture spaced from the third aperture and opposite the second aperture;
- a top side; and
- a bottom side opposite the top side, the top side, bottom side, back side, and first and second sides cooperatively forming an open-front dispensing chamber for receiving the roll therein;
- a first bearing positioned near the first aperture;
- a first biasing component configured to bias the first bearing towards the first aperture such that at least a portion of the first bearing extends through the first aperture;
- a second bearing positioned near the second aperture;
- a second biasing component configured to bias the second bearing towards the second aperture such that at least a portion of the second bearing extends through the second aperture;
- a third bearing positioned near the third aperture;
- a third biasing component configured to bias the third bearing towards the third aperture such that at least a portion of the third bearing extends through the third aperture;
- a fourth bearing positioned near the fourth aperture; and
- a fourth biasing component configured to bias the fourth bearing towards the fourth aperture such that at least a portion of the fourth bearing extends through the fourth aperture, the first and third bearings being configured to be selectively shifted away from the first and third apertures for inserting the first roll into a first seated position and being configured to retain the first roll in the first seated position when the first and third biasing components bias the first and third bearings towards the first and third apertures, the second and fourth bearings being configured to be shifted away from the second and fourth apertures for inserting the second roll into a second seated position and being configured to retain the second roll in the second seated position when the second and fourth biasing components bias the second and fourth bearings towards the second and fourth apertures;

a housing comprising:

an outer top wall spaced from the top side;

an outer bottom wall spaced from the bottom side;

a first outer sidewall spaced from the first side; and a second outer sidewall spaced from the second side; and an open-ended secondary chamber between the frame and the housing.

12. The apparatus of claim 11, further comprising a first retention structure forming a first chamber extending outwardly from the first aperture for retaining the first bearing and the first biasing component therein, a second retention structure forming a second chamber extending outwardly from the second aperture for retaining the second bearing and the second biasing component therein, a third retention structure forming a third chamber extending outwardly from the third aperture for retaining the third bearing and the third biasing component therein, and a fourth retention structure forming a fourth chamber extending outwardly from the fourth aperture for retaining the fourth bearing and the fourth biasing component therein.

13. The apparatus of claim 12, wherein the first and second retention structures are removably attached to the first side and the third and fourth structures are removably attached to the second side.

14. The apparatus of claim 12, wherein the first, second, third, and fourth retention structures being positioned in the open-ended secondary chamber.

15. The apparatus of claim 12, wherein the first, second, third, and fourth retention structures are accessible via the open-ended secondary chamber.

16. The apparatus of claim 11, further comprising a mounting structure positioned at the back of the apparatus for mounting the apparatus to an external structure.

17. The apparatus of claim 16, further comprising at least one fastener hole in the mounting structure for receiving a fastener therethrough.

18. The apparatus of claim 11, wherein the housing is shorter near its front than near its back so as to form an ergonomic shape.

19. The apparatus of claim 11, wherein the bearings are spherical.

20. The apparatus of claim 11, wherein the biasing components are coil springs.

* * * * *